US007061402B1

(12) United States Patent
Lawson

(10) Patent No.: US 7,061,402 B1
(45) Date of Patent: Jun. 13, 2006

(54) EMERGENCY VEHICLE WARNING SYSTEM

(76) Inventor: Robert Lawson, 1203 N. Bautista La., Colton, CA (US) 92324

( * ) Notice: Subject to any disclaimer, the term of this patent is extended or adjusted under 35 U.S.C. 154(b) by 0 days.

(21) Appl. No.: 10/945,187

(22) Filed: Sep. 20, 2004

Related U.S. Application Data

(60) Provisional application No. 60/509,857, filed on Oct. 9, 2003.

(51) Int. Cl.
*G08G 1/123* (2006.01)

(52) U.S. Cl. ..... 340/988; 340/989; 340/901; 340/902; 340/903; 701/301; 701/302

(58) Field of Classification Search ..... 340/988, 340/902, 901, 903, 989; 701/301, 302
See application file for complete search history.

(56) References Cited

U.S. PATENT DOCUMENTS 3,997,868 A * 12/1976 Ribnick et al. ..... 340/902
4,238,778 A * 12/1980 Ohsumi ..... 340/903
4,747,064 A * 5/1988 Johnston ..... 702/176
4,864,297 A * 9/1989 Shaw et al. ..... 340/902
5,926,112 A * 7/1999 Hartzell ..... 340/902
6,006,070 A * 12/1999 Wong ..... 455/63.1
6,614,362 B1 * 9/2003 Siegel ..... 340/902
6,763,118 B1 * 7/2004 Bodley et al. ..... 381/355
6,822,580 B1 * 11/2004 Ewing et al. ..... 340/902
2003/0102985 A1 * 6/2003 Turbeville et al. ..... 340/902
2004/0155795 A1 * 8/2004 Quintana ..... 340/902

* cited by examiner

*Primary Examiner*—Tai T. Nguyen
(74) *Attorney, Agent, or Firm*—Goldstein Law Offices PC.

(57) ABSTRACT

An emergency vehicle warning system comprising a transmitter unit positioned within an emergency vehicle, and a receiver unit positioned within a passenger vehicle, wherein upon receipt of a radio frequency activation signal from the transmitter unit, an electronic chime within the receiver unit emits an audible alert, and thereby warns the driver of the passenger vehicle of the approaching emergency vehicle. The receiver unit additionally displays the relative position of the emergency vehicle upon a display panel. The receiver unit is additionally activated by sound waves associated with the siren of the emergency vehicle. The warning system alerts the driver to the approaching emergency vehicle before hearing the siren of the emergency vehicle, and thereby provides enough time for the driver of the passenger vehicle to safely pull over to the side of the road in order to allow the emergency vehicle to pass.

3 Claims, 3 Drawing Sheets

EMERGENCY VEHICLE WARNING SYSTEM

CROSS REFERENCES AND RELATED SUBJECT MATTER

This application is a continuation of provisional patent application Ser. No. 60/509,857, filed in the United States Patent Office on Oct. 9, 2003.

BACKGROUND OF THE INVENTION

1. Field of the Invention

The invention generally relates to a warning system, and in particular relates to an emergency vehicle warning system comprising a transmitter unit positioned within an emergency vehicle, and a receiver unit positioned within a passenger vehicle, wherein upon receipt of an activation signal from the approaching emergency vehicle, the receiver unit provides an audible alert, and additionally displays the relative position of the emergency vehicle upon a display panel.

2. Description of the Related Art

While driving in a passenger vehicle along a road, it is the responsibility of every driver to yield the right of way to an approaching emergency vehicle such as a fire truck, an ambulance, or a police car. This generally involves pulling over to the far right of the road in order to give the emergency vehicle enough room to drive by quickly and safely. However, there is often not enough time between the time the driver hears the siren of the emergency vehicle and the time at which the emergency vehicle reaches the passenger vehicle for the driver to yield the right of way. Accordingly, there is a need for an emergency vehicle warning system having a transmitter unit positioned within an emergency vehicle and having a receiver unit positioned within a passenger vehicle, wherein receipt of an activation signal from the transmitter unit causes the receiver unit to emit an audible alert and to display the relative position of the emergency vehicle upon a display panel, thereby giving the driver of the passenger vehicle enough time to pull over to the side of the road or to take other evasive action as necessary.

A variety of emergency vehicle warning systems have been devised. For example, U.S. Pat. No. 5,808,560 to Mulanax appears to show an emergency vehicle warning system comprised of a transmitter carried by an emergency vehicle and a radio frequency receiver capable of alerting the driver of a passenger vehicle. Additionally, U.S. Pat. No. 6,160,493 to Smith appears to show a warning system for alerting a driver of potential hazards such as the approach of an emergency vehicle, comprising a transmitter and receiver pair. Furthermore, U.S. Pat. No. 4,587,522 to Warren appears to show a warning system which converts audio signals from an emergency vehicle into discrete signals, and which alerts passenger vehicles by audio and/or visual alarms. Moreover, U.S. Pat. No. 4,238,778 to Oshumi appears to show a warning system which operates upon the generation and receipt of radio signals.

While these devices may be suitable for the particular purpose employed, or for general use, they would not be as suitable for the purposes of the present invention as disclosed hereafter.

SUMMARY OF THE INVENTION

It is an object of the invention to provide an emergency vehicle warning system which provides an audible alert to the driver of a passenger vehicle as to the approach of an emergency vehicle. Accordingly, the warning system has both a passenger vehicle-installed receiver unit and an emergency vehicle-installed transmitter unit. The receiver unit has an electronic chime which emits an audible alert upon receipt of an activation signal from the transmitter unit, thereby providing an audible alert to the driver of the passenger vehicle as to the approach of the emergency vehicle.

It is another object of the invention to provide an emergency vehicle warning system which provides a visual indication as to the direction of approach of the emergency vehicle to the passenger vehicle. Accordingly, the receiver unit has a display panel having a substantially circular orientation display compass having a plurality of lights positioned at its periphery. Selective illumination of one of the lights at the periphery provides a visual indication as to the direction of approach of the emergency vehicle to the passenger vehicle.

Further objects of the invention will become apparent in the detailed description of the invention which follows.

The invention is an emergency vehicle warning system comprising a transmitter unit positioned within an emergency vehicle, and a receiver unit positioned within a passenger vehicle, wherein upon receipt of a radio frequency activation signal from the transmitter unit, an electronic chime within the receiver unit emits an audible alert, and thereby warns the driver of the passenger vehicle of the approaching emergency vehicle. The receiver unit additionally displays the relative position of the emergency vehicle upon a display panel. The receiver unit is additionally activated by sound waves associated with the siren of the emergency vehicle. The warning system alerts the driver to the approaching emergency vehicle before hearing the siren of the emergency vehicle, and thereby provides enough time for the driver of the passenger vehicle to safely pull over to the side of the road in order to allow the emergency vehicle to pass.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 3:
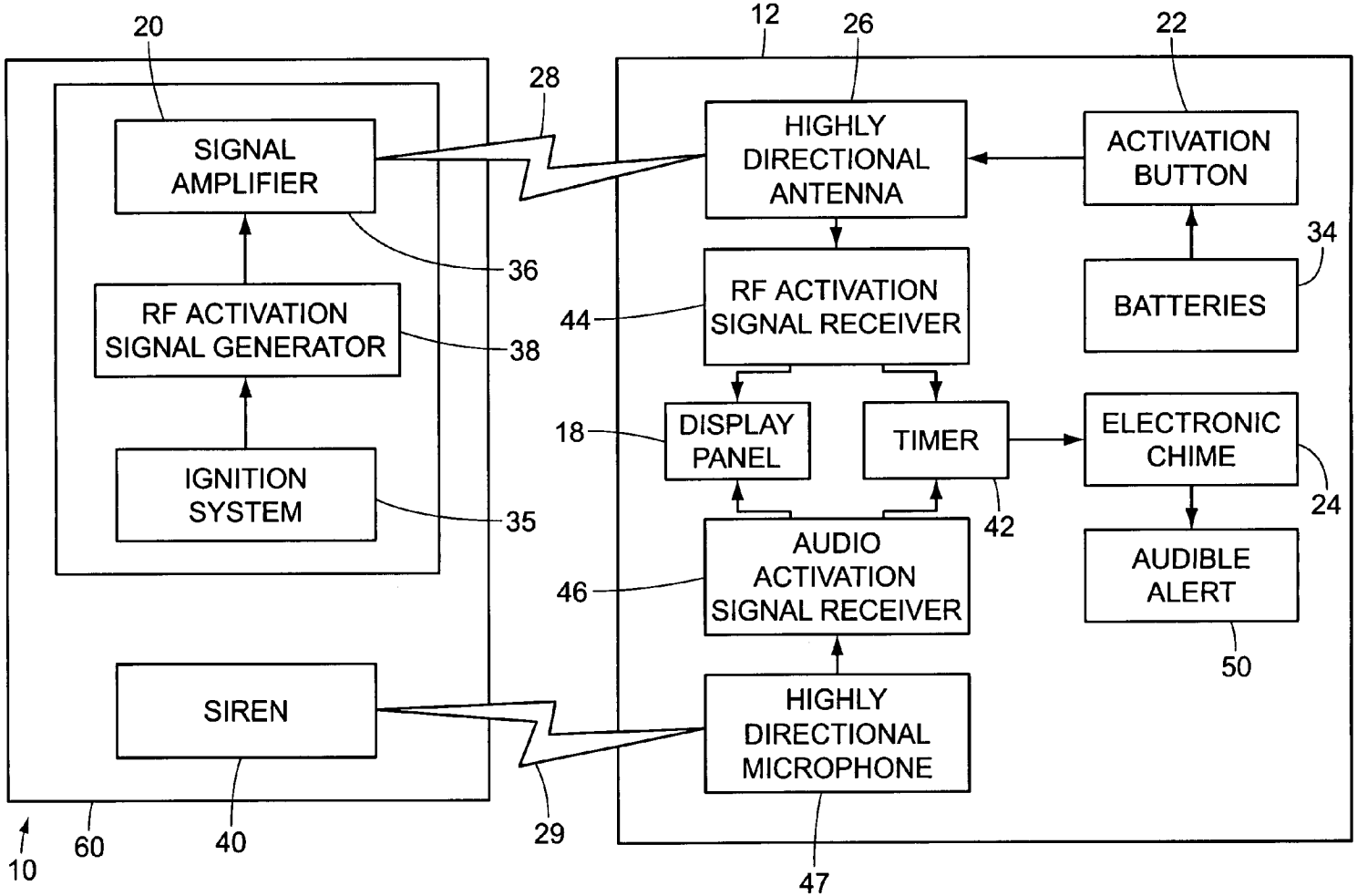
FIG. 3 is a block diagram illustrating the interconnection of various electrical components of the invention.

Turning momentarily to FIG. 3, the emergency vehicle warning system 10 comprises both a passenger vehicle-installed receiver unit 12 and an emergency vehicle-installed transmitter unit 20. The receiver unit 12 is selectively mounted within a passenger vehicle. Analogously, the transmitter unit 20 is selectively mounted within an emergency vehicle 60 having a siren 40. The receiver unit 12 and the transmitter unit 20 communicate with one another by selective transmission of radio frequency (RF) activation signals 28 by the transmitter unit 20, and by receipt of the signals 28 by the receiver unit 12, and also by receipt of sound waves 29 selectively produced by the siren 40 by the receiver unit 12, as will be described.

Figure 1:
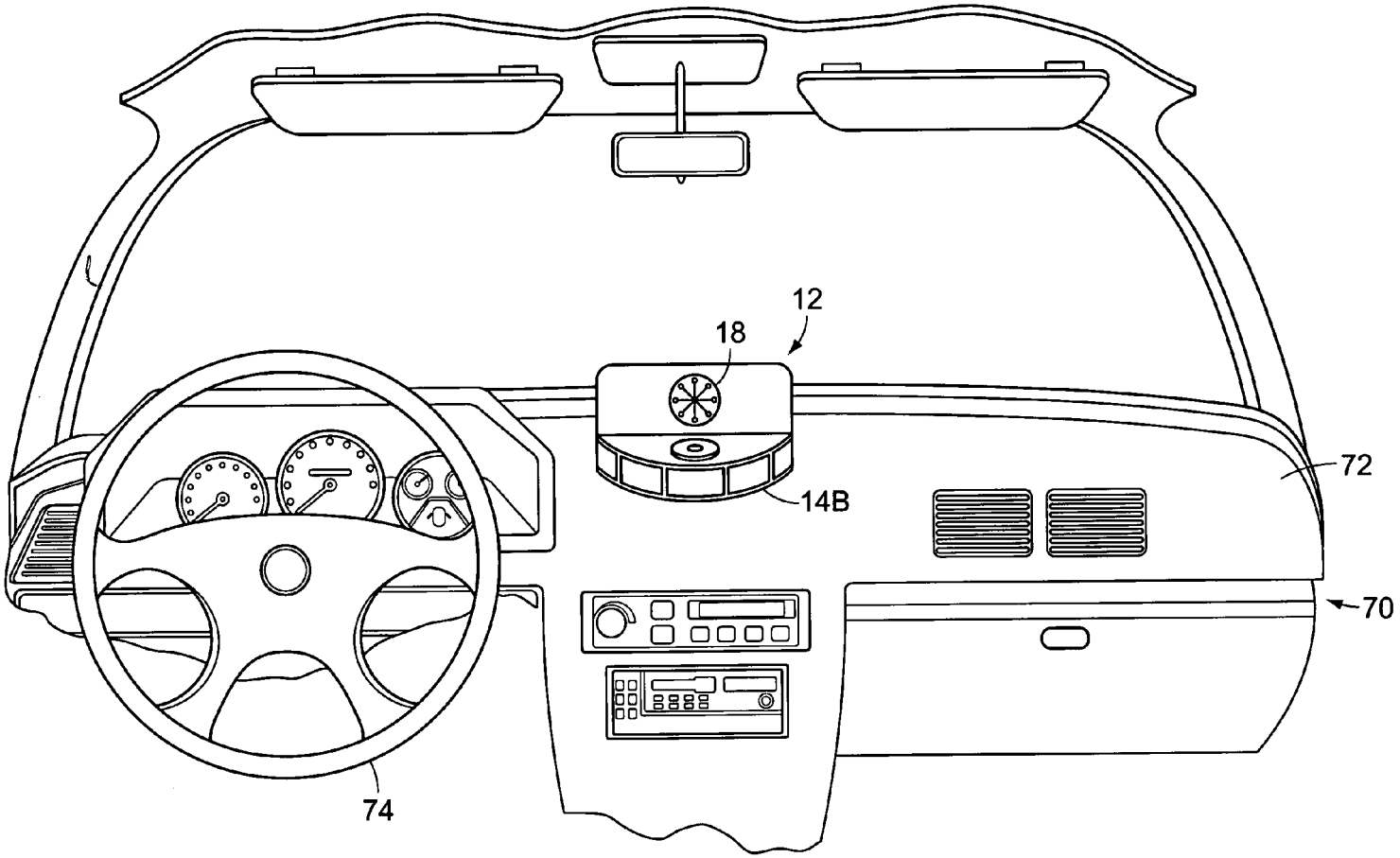
FIG. 1 is a perspective view of a receiver unit of an emergency vehicle warning system after selective attachment to a dashboard of a passenger vehicle.
Figure 2:
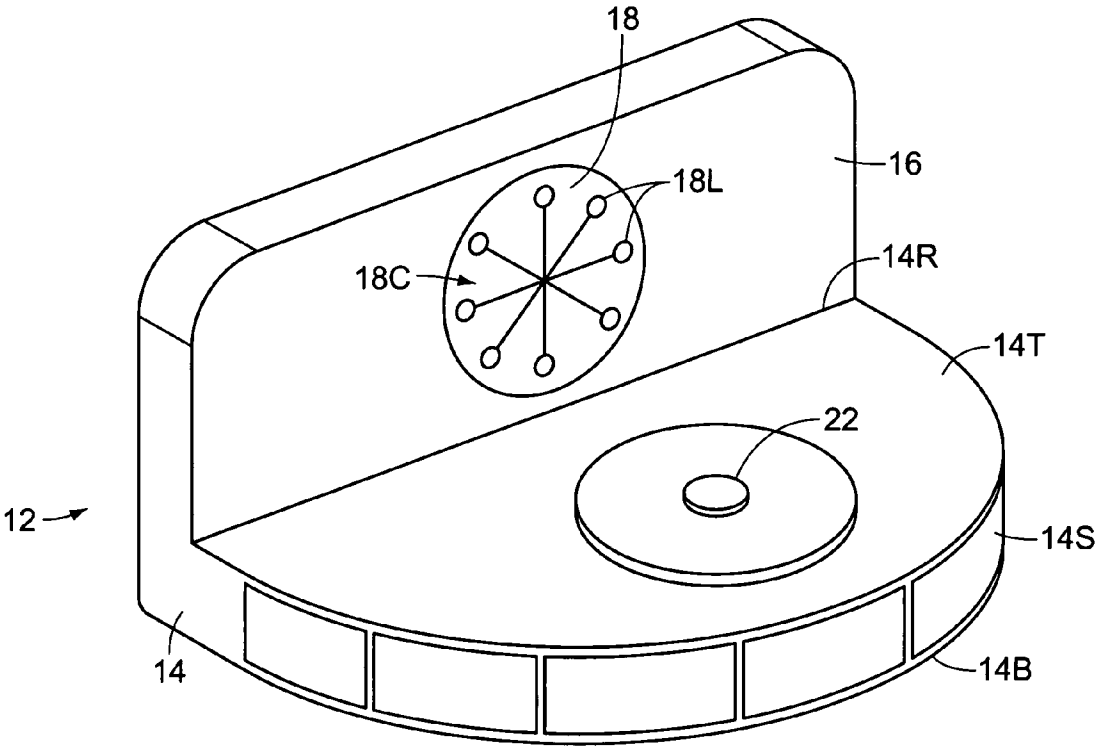
FIG. 2 is a perspective view of the receiver unit, per se.

FIG. 2 illustrates the receiver unit 12, having a substantially hemispherical dashboard mount 14, and a substantially rectangular display panel backboard 16. The dashboard mount 14 has a straight rear 14R, a top 14T, a bottom 14B, and an arcuate side wall 14S extending between the top 14T and the bottom 14B. Turning momentarily to FIG. 1, the receiver unit 12 is selectively installed into a passenger vehicle 70 having a dashboard 72 and having a steering wheel 74, by selectively attaching the bottom 14B of the dashboard mount 14 to the dashboard 72 of the passenger vehicle 70. Returning to FIG. 2, the display panel backboard 16 extends vertically upward from the rear 14R of the dashboard mount 14. The display panel backboard 16 has a display panel 18, preferably of the liquid crystal display (LCD) variety. The display panel 18 has a substantially circular orientation display compass 18C which is divided into four quadrants. The compass 18C provides a visual indication of the direction of approach of the emergency vehicle 60. In particular, the compass 18C has a periphery and a plurality of lights 18L positioned at its periphery. Only the light 18L whose position upon the periphery corresponds to the position of the emergency vehicle 60 will be selectively illuminated at any given time. For example, an emergency vehicle 60 which is approaching from the left of the passenger vehicle 70 will cause one of the lights 18L positioned in the western quadrant of the orientation display compass 18C to be selectively illuminated. The orientation display compass 18C is easily viewed by the driver seated behind the steering wheel 74.

The receiver unit 12 contains an electronic chime 24 which emits an audible alert upon selective receipt of either an RF activation signal 28 emitted by the transmitter unit 20 or of sound waves 29 emitted by the siren 40 of the emergency vehicle, as will be described.

FIG. 3 is a block diagram illustrating the interconnection of various electrical components of the invention. In particular, it illustrates the interconnection between the passenger vehicle-installed receiver unit 12 and the emergency vehicle-installed transmitter unit 20 and it indicates the various components of each. It further illustrates the interaction between the emergency vehicle siren 40 and the passenger vehicle-installed receiver unit 12. The transmitter unit 20 is installed into an emergency vehicle 60 having an ignition system 35 and having a siren 40 capable of selectively emitting sound waves 29 for warning pedestrians and passenger vehicles 70 that the emergency vehicle 60 is approaching. The transmitter unit 20 has a radio frequency (RF) activation signal generator 38 which produces a radio frequency (RF) activation signal 28 upon selective activation of the siren 40 of the emergency vehicle 60. The receiver unit 12 contains an RF activation signal receiver 44 for receiving the radio frequency activation signal 28 generated by the transmitter unit 20. The receiver unit 12 also contains an audio activation signal receiver 46 for receiving sound waves 29 emitted from the siren 40 of the emergency vehicle 60, as will be described. The RF activation signal generator 38 within the emergency vehicle-installed transmitter unit 20 communicates with the activation signal receiver 24 within the passenger vehicle-installed receiver unit 12 via transmission of the RF activation signal 28. The RF activation signal generator 38 is selectively powered by the ignition system 35 of the emergency vehicle 60. The transmitter unit 20 has a signal amplifier 36 for increasing the amplitude of the signal produced by the RF activation signal generator 38 prior to emission of the RF activation signal 28 by the transmitter unit 20. The receiver unit 12 has a highly directional antenna 26 which receives the RF activation signal 28 emitted by the transmitter unit 20, and directs the signal 28 to the RF activation signal receiver 44, which tunes and isolates the signal 28 from other miscellaneously-derived radio frequency signals.

The audio activation signal receiver 46 of the receiver unit 12 detects sound waves of a frequency characteristic of the siren 40 of the emergency vehicle 60. The receiver unit 12 further has a highly directional microphone 47 which receives the sound waves 29 emitted by the siren 40 and by other sources, and directs the signal which arises from the sound waves to the audio activation signal receiver 46, which tunes and isolates the sound waves 29 produced by the siren 40 from other miscellaneously-derived audible signals.

Upon receipt of an RF activation signal 28 originating from the RF activation signal generator 38 of the transmitter unit 20, the RF activation signal receiver 44 activates the orientation display compass 18C of the display panel 18 to visually indicate the direction of approach of the emergency vehicle 60 by selectively illuminating one of the plurality of lights 18L of the compass 18C. In similar fashion, upon receipt of sound waves 29 originating from the siren 40 of the emergency vehicle 60, the audio activation signal receiver 46 also activates the orientation display compass 18C of the display panel 18 to visually indicate the direction of approach of the emergency vehicle 60. The receiver unit 12 has a timer 42 in electrical communication with the electronic chime 24. Simultaneous with the activation of the orientation display compass 18C of the display panel 18, the timer 42 is activated, and causes the electronic chime 24 to emit an audible alert 50 at regular intervals, thereby providing an audible warning of the approach of the emergency vehicle 60, in addition to the visual alert provided by the orientation display compass 18C of the display panel 18.

The passenger vehicle-installed receiver unit 12 has an activation button 22 for selectively activating the receiver unit 12. Returning momentarily to FIG. 2, the activation button 22 is positioned on top 14T of the dashboard mount 14 of the receiver unit 12. The receiver unit contains batteries 34 for selectively powering the receiver unit 12.

In use, the receiver unit 12 is mounted within the passenger vehicle 70. The transmitter unit 20 is mounted within the emergency vehicle 60 and electrically connected to the ignition system 35 of the emergency vehicle 60. The receiver unit 12 is in selective communication with transmitter unit 20. In particular, as the emergency vehicle 60 approaches the passenger vehicle 70, the RF activation signal receiver 44 is activated by the RF activation signal 28 emitted by the RF activation signal generator 38 of the transmitter unit 20. Additionally, the audio activation signal receiver 46 is activated by the sound waves 29 emitted by the siren 40. Activation of either the RF activation signal receiver 44 or the audio activation signal receiver 46 causes the display panel 18 to selectively display the direction of approach of the emergency vehicle 60 upon the orientation display compass 18C. Simultaneous with the activation of the display panel 18, the timer 42 is activated, thereby causing the electronic chime 24 to emit an audible alert 50 at regular intervals as determined by the timer 42, thereby providing an audible indication of the approaching emergency vehicle 60, in addition to the visual indication provided by the orientation display compass 18C.

In conclusion, herein is presented an emergency vehicle locating system, comprised of an emergency vehicle-mounted transmitter unit in communication with a passenger vehicle-mounted receiver unit, for alerting the driver of the passenger vehicle of the approach and also the direction of approach of the emergency vehicle. The invention is illustrated by example in the drawing figures, and throughout the written description. It should be understood that numerous variations are possible, while adhering to the inventive concept. Such variations are contemplated as being a part of the present invention.

What is claimed is:

1. An emergency vehicle locating system, for alerting a driver of an existing passenger vehicle of the approach and also the direction of approach of an existing emergency vehicle, said emergency vehicle having an ignition system, and having a siren which selectively emits sound waves, comprising:

a transmitter unit selectively mounted within the emergency vehicle, having:

a radio frequency (RF) activation signal generator which produces a radio frequency (RF) activation signal upon selective activation of the siren of the emergency vehicle;

a signal amplifier for increasing the amplitude if the signal produces by the RF activation signal generator prior to emission of the RF activation signal by the transmitter unit;

a receiver unit selectively mounted within the passenger vehicle, having:

an RF activation signal receive for receiving the radio frequency activation signal generated by the transmitter;

an audio activation signal receiver for receiving sound waves of a frequency characteristic of the siren of the emergency vehicle;

a display panel having an orientation display compass having a periphery and plurality of lights positioned at its periphery, said compass for providing a visual indication of the direction of the approach of the emergency vehicle;

an electronic chime which emits an audible alert upon selective receipt of either ran RF activation signal emitted by the transmitted unit or of sound waves emitted by the siren of the emergency vehicle;

a highly directional microphone which receives the sound waves emitted by the siren and by other sources, and directs the signal which arises from the sound waves to the audio activation signal receiver, which tunes and isolates the sound waves produced by the siren from other miscellaneously-derived audible signals;

a highly directional antenna which receives the RF activation signal emitted by the transmitter unit, and directs signal to the RF activation signal receiver, which tunes and isolates the signal from other miscellaneously-derived audible signals;

an activation button for selectively activating the receiver unit; and wherein upon receipt of an RF activation signal originating from the RF activation signal generator of the transmitter unit, the RF activation signal receiver activates the orientation display compass of the display panel to visually indicate the direction of approach of the emergency vehicle by selectively illuminating only the light whose position upon the periphery corresponds to the position of the emergency vehicle, and wherein upon receipt of sound waves originating from the siren of the emergency vehicle, the audio activation signal receiver also activates the orientation display compass of the display panel to visually indicate the direction of approach of the emergency vehicle.

2. The emergency vehicle locating system as recited in claim 1, wherein the receiver unit has a timer in electrical communication with the electric chime, where in simultaneous with the activation of the orientation display compass of the display panel, the timer is activated, and causes the electronic chime to emit an audible alert at regular intervals, thereby providing an audible warning of the approach of the emergency vehicle, in addition to the visual alert provided by the orientation display compass of the display panel.

3. The emergency vehicle locating system as recited in claim 2, wherein the RF activation signal generator is selectively powered by the ignition system of the emergency vehicle.

* * * * *